US005756994A

United States Patent [19]

Bajic

[11] Patent Number: 5,756,994

[45] Date of Patent: May 26, 1998

[54] ELECTROSPRAY AND ATMOSPHERIC PRESSURE CHEMICAL IONIZATION MASS SPECTROMETER AND ION SOURCE

[75] Inventor: Stevan Bajic, Sale, England

[73] Assignee: Micromass Limited, Manchester, England

[21] Appl. No.: 766,299

[22] Filed: Dec. 13, 1996

[30] Foreign Application Priority Data

Dec. 14, 1995 [GB] United Kingdom ..... 9525507

[51] Int. Cl.[6] ..... H01J 49/04

[52] U.S. Cl. ..... 250/288

[58] Field of Search ..... 250/288, 288 A, 250/281, 282, 423 R

[56] References Cited

U.S. PATENT DOCUMENTS

| | | | |
|---|---|---|---|
| 4,667,100 | 5/1987 | Lagna | 250/282 |
| 4,730,111 | 3/1988 | Vestal et al. | 250/288 |
| 5,412,208 | 5/1995 | Covey et al. | 250/288 |
| 5,495,108 | 2/1996 | Apffel, Jr. et al. | 250/288 |
| 5,559,326 | 9/1996 | Goodley et al. | 250/288 |

FOREIGN PATENT DOCUMENTS 0 252 758 1/1988 European Pat. Off. .

*Primary Examiner*—Kiet T. Nguyen
*Attorney, Agent, or Firm*—Alix, Yale & Ristas, LLP

[57] ABSTRACT

Atmospheric Pressure Chemical Ionization (APCI) and electrospray ionization sources for the mass spectrometric analysis of solutions, and associated methods. The apparatus and methods are characterised in that ions generated by APCI or electrospray are directed such that their directions of travel immediately on formation can be resolved into two perpendicular components, one of which is aligned with a linear first trajectory which passes through an entrance orifice, an extraction chamber and into an evacuation port through which the extraction chamber is evacuated. The direction of travel is such that the component of velocity so aligned is smaller than the component perpendicular to it. Ions leave the chamber along a second trajectory which is inclined at an angle between 30° and 150° to the linear first trajectory and may pass into a mass analyzer. The apparatus and method provide improved sensitivity and a lower noise level in comparison with prior apparatus and methods using APCI and electrospray ionization sources.

15 Claims, 5 Drawing Sheets

ELECTROSPRAY AND ATMOSPHERIC PRESSURE CHEMICAL IONIZATION MASS SPECTROMETER AND ION SOURCE

FIELD OF THE INVENTION

This invention relates to apparatus and methods for mass spectrometry, and in particular to methods and apparatus for the ionization of high-molecular weight thermally labile samples.

BACKGROUND OF THE INVENTION

Ion sources which ionize a sample at atmospheric pressure rather than at high vacuum are particularly successful in producing intact molecular ions of thermally labile high-molecular weight samples. Of these sources, electrospray sources are amongst the most successful. Although the basic technique of electrospray was known much earlier, the first practical source designs suitable for organic mass spectrometry appeared in 1984 (e.g., EP 0123552A). This application teaches an ion source comprising a capillary tube through which a solution of a sample to be analyzed is pumped, and which is maintained at a high potential relative to a grounded counter electrode disposed opposite its downstream end. A small orifice, axially aligned with the capillary tube, is formed in the counter electrode and leads via a nozzle-skimmer arrangement into a quadrupole mass analyzer. In an alternative arrangement the orifice in the counter electrode may be the entrance to a second (transfer) capillary, which through the application of a suitable potential difference along its length, can be used to increase the energy of the ions passing along it to a level appropriate for analysis by a magnetic sector spectrometer (See EP 0123553). A flow of heated inert gas is introduced into the region between the end of the spray capillary tube and the counter electrode in a direction opposed to that of the flow of liquid from the tube. The spray capillary tube is maintained at a potential between +3 and +10 kV relative to the counter electrode so that the liquid emerging from it is electrosprayed into a counter-current of inert gas. This results in the formation of ions characteristic of the solute which pass through the nozzle-skimmer system into the mass analyzer.

Various improvements to this basic electrospray ion source have been proposed. Bruins, et al, (34th Ann. Confr. on Mass Spectrometry and Allied Topics, Cincinnati, 1986, pp 585–6, and in U.S. Pat. No. 4861988) describes a pneumatically assisted electrospray source wherein a coaxial nebulizer fed with an inert gas is used in place of the capillary tube of the basic source in order to assist in the formation of the aerosol. These authors also teach that the capillary tube or nebulizer should not be directed straight at the orifice in the counter-electrode but should be disposed parallel to the optical axis of the mass analyzer (which passes through the entrance orifice) and displaced 5–10 mm from it. However, sources of this type are often operated in practice with the capillary tube inclined at an angle to the optical axis of the mass analyzer, usually at about 30°, but still directed towards the orifice. U.S. Pat. No. 5015845 discloses an additional heated desolvation stage which operates at a pressure of 0.1–10 torr and is located downstream of the first nozzle. U.S. Pat. Nos. 5,103,093, 4,977,320 and Lee, Henion, Rapid Commun. in Mass Spectrom. 1992, vol 6 pp 727–733, and others, teach the use of a heated inlet capillary tube. U.S. Pat. No. 5,171,990 teaches an off-axis alignment of the transfer capillary tube and the nozzle-skimmer system to reduce the number of fast ions and neutrals entering the mass analyzer. U.S. Pat. No. 5,352,892 discloses a liquid shield arrangement which minimizes the entry of liquid droplets entering the mass analyzer vacuum system.

It has been realised that a major factor in the success of electrospray ionization sources for high-molecular weight samples is that, in contrast with most other ion sources, ionization takes place at atmospheric pressure. Recently, therefore, there has been a revival of interest in APCI (atmospheric pressure chemical ionization) sources which are also capable of generating stable ions characteristic of high molecular weight thermally labile species. Such sources are generally similar to electrospray sources except for the mode of ionization. In place of the inlet capillary maintained at high potential, APCI sources provide a source of electrons, for example, a β-emitter (typically $^{63}$Ni foil) (See McKeown, Siegel, American Lab. Nov. 1975 pp 82–99, and Horning, Carroll et al, Adv. in Mass Spectrom. Biochem. Medicine, 1976 vol 1 pp 1–16) or a corona discharge (See Carroll, Dzidic et al, Anal. Chem. 1975 vol 47 (14) pp 2369). In these early sources the high pressure ionization region was separated from the high vacuum region containing the mass analyzer by a diaphragm containing a very small orifice disposed on the optical axis of the analyzer. Later APCI sources are of two types, those involving nozzle-skimmer separator systems in place of the diaphragm (e.g., Kambara, et al, Mass Spectroscopy (Japan) 1976 vol 24 (3) pp 229–236 and GB patent application 2183902 A) and those involving a clean flow of inert gas in front of an orifice somewhat larger than previously used through which the ions must travel to reach the analyzer (e.g., GB patent 1582869).

With the exception of certain electrospray sources (discussed above) all these prior electrospray and APCI sources comprise an on-axis alignment of the orifice or capillary which links the high and low pressure regions with the optical axis of the spectrometer. Furthermore, in all the prior sources where the sample is comprised in a flow of liquid or gas the direction of that flow in the atmospheric pressure region of the source is in every case directed generally towards the orifice or inlet capillary.

Because recent experience has suggested that electrospray and APCI sources are in general more sensitive than thermospray sources (for example, that disclosed in GB 2207548 A), details of the conversion of several types of prior thermospray sources into electrospray sources have been published (e.g., U.S. Pat. No. 5,235,186, Duffin, Wacks et al. Anal. Chem 1992 vol 64 pp 61–68, and Jacket, and Moni in Rev. Sci. Instrum. 1994 vol 65 (3) pp 591–6). However, such a conversion alters the nature of the source because in thermospray sources, gaseous phase ionization takes place at a pressure between 1 and 10 torr as a consequence of a high input of heat to a jet of liquid expanding into an evacuated region. After conversion the previously evacuated region becomes an atmospheric pressure region into which a jet of liquid can be electrosprayed in exactly the same orientation as the prior electrospray sources discussed above.

SUMMARY OF THE INVENTION

It is an object of the invention to provide an improved electrospray ion source having comparable or better sensitivity than prior sources and which is capable of longer periods of operation between maintenance operations than prior sources. It is a further object to provide an improved method of ionizing a solute in a solution by electrospray and a yet further object to provide an improved mass spectrometer having such an electrospray ionization source. It is a yet further object to provide an improved APCI source having comparable or better sensitivity than prior sources and which is capable of longer periods of operation between maintenance operations than prior sources. It is yet another object to provide an improved mass spectrometer having such an APCI source.

In the following, the term "particle" is meant to include any species which may be obtained by nebulizing or electrospraying a solution comprising a sample, for example molecules, ions, solvated or clustered molecules or ions, or droplets of solution.

According to the invention there is provided an ion source for generating ions for analysis, comprising an extraction chamber formed in a body, said extraction chamber being in communication with an evacuation port, evacuation means connected to said evacuation port for maintaining the pressure in said extraction chamber less than 100 mm Hg, an entrance orifice leading into said extraction chamber and disposed opposite to said evacuation port so that at least some molecules entering said extraction chamber through said entrance orifice may pass through said extraction chamber on linear first trajectories and enter said evacuation port, exit orifice means leading through said body from said extraction chamber, means for generating a potential gradient in said extraction chamber for deflecting said ions for analysis through said exit orifice on second trajectories which are inclined at between 30° and 150° to said linear first trajectories, particle generating means for receiving a solution in which a sample may be dissolved and generating therefrom a stream of particles which intersects outside said body a notional backwards projection of at least one of said linear first trajectories through said entrance orifice, and means for electrically charging at least some of the particles comprised in said stream before they reach said notional backwards projection, wherein said particle generating means is further disposed with respect to said entrance orifice so that immediately on leaving said particle generating means at least the majority of particles comprised in said stream have a velocity whose resolved component towards said entrance orifice in a direction parallel to any one of said linear first trajectories is smaller than the resolved component in a perpendicular direction.

In preferred embodiments an entrance chamber is additionally provided between the entrance orifice and the extraction chamber, and both the entrance chamber and the evacuation port are of greater diameter than the extraction chamber.

The invention provides both electrospray ionization and atmospheric pressure chemical ionization (APCI) sources. In an electrospray ionization source according to the invention, said particle generating means comprises aerosol generating means and said means for electrically charging said particles may comprise means for maintaining said aerosol generating means at a high potential relative to said body. Said aerosol generating means may comprise a capillary tube, or a pneumatic or ultrasonic nebulizer may be employed to assist the electrospray process. In an atmospheric pressure chemical ionization source according to the invention, said particle generating means may comprise aerosol generating means for generating droplets from a solution and aerosol heating means, typically a strongly heated tube, for generating molecules in the gaseous phase from said droplets by evaporating solvent therefrom, and said means for electrically charging said particles may comprise discharge electrode means disposed adjacent to said stream and maintained at a potential which results in the formation of a corona discharge between the body and the discharge electrode.

Preferably the exit orifice means comprises a hollow conical member disposed in the body and comprising a hole in its apex, a portion of which member may extend into the extraction chamber. Further preferably, the exit orifice means extends to a point at least 1 mm short of any of the first linear trajectories. The distance between the most extreme of the first linear trajectories and the apex of the exit orifice means may be adjusted to control the degree of fragmentation of ions in the extraction chamber for a given electrode potential. In general, the greater this distance (i.e., the shorter the conical member) the greater is the fragmentation. Similarly, the magnitude of the potential gradient in the extraction chamber also affects the degree of fragmentation. Increasing the magnitude of the potential gradient typically increases the degree of fragmentation of the ions produced by the source.

Heating means may also be provided to maintain the temperature of the body about 150° C. for the majority of samples, or at about 70° C. for thermally labile samples such as proteins. Typically the entrance orifice may comprise a hole between 0.3 and 1.5 mm diameter, and most preferably between 0.4 and 1.0 mm diameter.

In a further preferred embodiment the particle generating means is oriented so that the stream of particles intersects a notional projection of any of said linear trajectories backwards through said entrance orifice at an angle of about 90°. In the electrospray embodiment, the body may extend to intersect the stream of particles to define a counter-electrode for the purposes of electrospraying the solution from the aerosol generating means. Typically, a potential difference of between 1 and 5 kV is maintained between the generating means and the body in order to cause the electrospray to be generated, and most preferably the potential difference is about 3.5 kV.

The invention further provides a mass spectrometer comprising an ion source as defined above and a mass analyzer disposed to receive ions passing through said exit orifice means. Preferably said mass analyzer comprises an analyzer entrance aperture which is disposed so that at least some of said second trajectories pass through it. Most preferably, the analyzer entrance aperture is disposed so that those of said second trajectories which make an angle of approximately 90° to one of said linear first trajectories pass through it.

Conveniently a quadrupole mass analyzer may be employed, but it is within the scope of the invention to use any other suitable type of mass analyzer, for example a magnetic sector analyzer or a time-of-flight mass analyzer. Ion transmission means, for example hexapole or quadrupole RF energized electrostatic lenses, may advantageously be disposed between the exit orifice means and the analyzer entrance aperture to increase the transmission efficiency of ions into the analyzer.

Viewed from another aspect the invention provides a method of ionization comprising generating a stream of particles from a solution in which a sample to be ionized may be dissolved, electrically charging at least some of the particles in said stream, receiving at least some of the particles so charged through an entrance orifice into an extraction chamber formed within a body along linear first trajectories which pass from said entrance orifice through said extraction chamber into an evacuation port, evacuating said chamber through said evacuation port to maintain the pressure in said extraction chamber less than 100 mm Hg, generating in said chamber a potential gradient to deflect at least ions travelling along at least some of said linear first trajectories along second trajectories through an exit orifice means, said second trajectories being inclined at between 30° and 150° to said linear first trajectories, wherein said stream of particles is oriented with respect to said body and said entrance orifice so that immediately on their formation at least the majority of particles comprised in said stream of particles have a velocity whose resolved component towards said entrance orifice in a direction parallel to any of said linear first trajectories is smaller than the resolved component in a perpendicular direction.

The invention provides both a method of ionization by electrospray or by APCI. In the former method the solution may be electrosprayed from an aerosol generator or capillary tube maintained at a high potential relative to the body to produce a stream of electrically charged particles, at least some of which enter the entrance orifice. In the latter method, an aerosol generator is used to produce a stream of particles at least some of which may subsequently acquire electrical charge by, for example, passing through a corona discharge established between a discharge electrode and the body as in prior APCI sources. In APCI methods the stream of particles may be produced by passing the solution into aerosol generating means to generate an aerosol comprising droplets of the solution and subsequently evaporating the solvent from the droplets by passing them through aerosol heating means (typically a heated tube) so that only particles in the gaseous phase are present in the stream of particles.

The invention also provides a method of mass spectrometrically analyzing a solution in which a sample may be dissolved which comprises a method as defined above and the additional step of mass analyzing ions which pass through said exit orifice means along said second trajectories.

Certain embodiments of the invention will now be described by way of example and with reference to the figures.

DETAILED DESCRIPTION OF THE PREFERRED EMBODIMENTS

Figure 1:
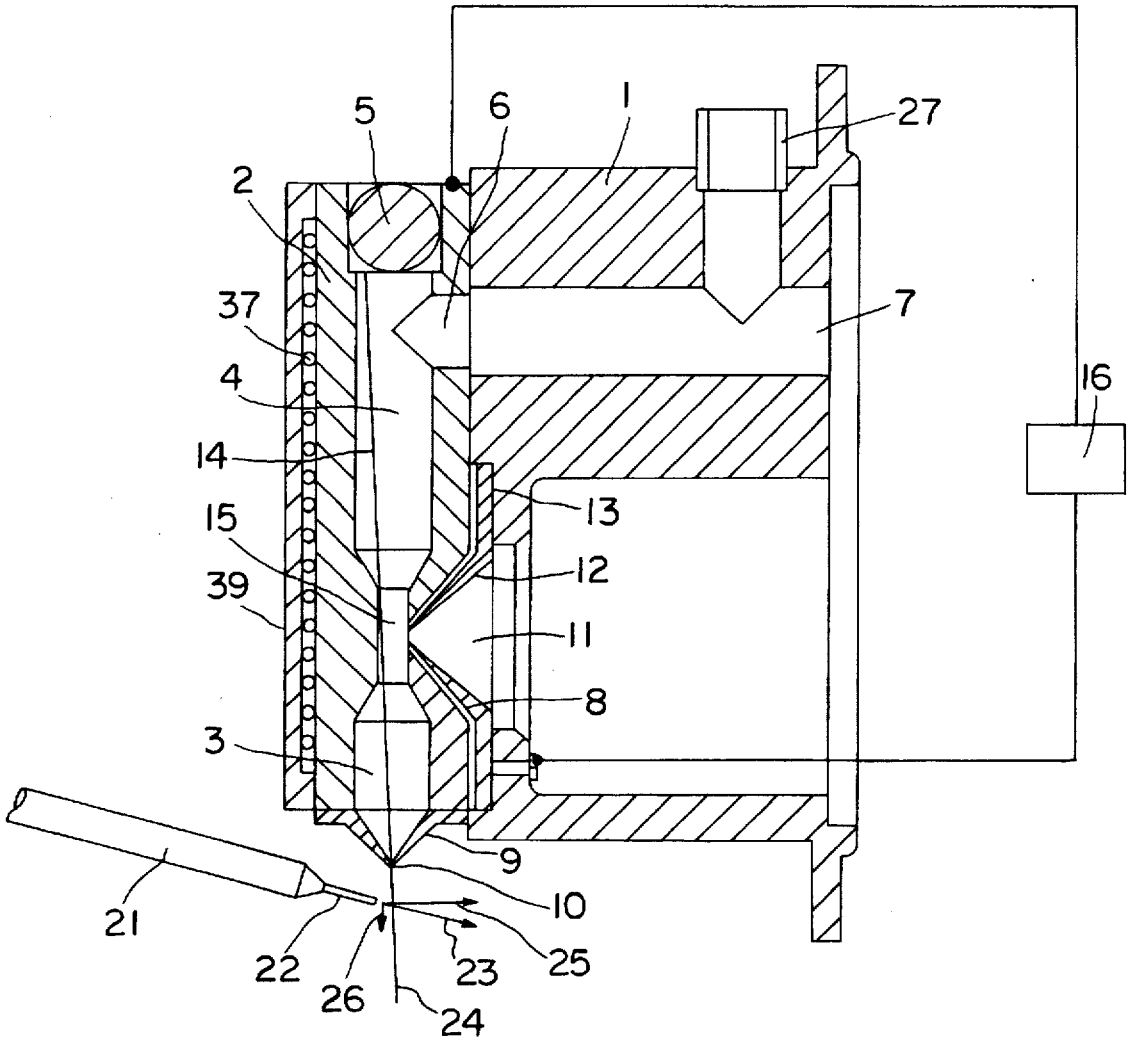
FIG. 1 is a sectional view of an ionization source according to the invention.

Referring first to FIG. 1, an electrospray ionization source according to the invention is built on a circular adaptor flange 1 made of a filled PTFE such as PEEK, and comprises an electrically conductive cylindrical body 2 made of stainless steel in which is formed an entrance chamber 3 and an evacuation port 4 which extend radially inside the body 2 and are connected via a smaller diameter extraction chamber 15. The evacuation port 4 is conveniently formed by drilling from the outside of the body 4, and in order to seal its open end a stainless steel ball 5 is pressed into it as shown in FIG. 1. The evacuation port 4 is connected to an evacuation means 19 (FIG. 2) through passages 6 and 7, respectively formed by drillings in the body 2 and the adaptor flange 1, a pipe adaptor 27 and a flexible vacuum hose 20. The evacuation means 19 may comprise a mechanical vacuum pump of about 30 $m^3$/hour capacity, which will maintain the pressure in the extraction chamber 15 less than 100 mm Hg, and typically in the range 1–10 mm Hg.

The external surface of the body 2 comprises a flat portion to which a hollow entrance cone 9 is secured by screws (not shown). The entrance cone 9 has formed in its apex an entrance orifice 10 which has a diameter between 0.4 and 1.0 mm selected to control the pressure in the extraction chamber 15. Using a 30 $m^3$/hour pump, a 0.4 mm diameter orifice will result in a pressure of about 3 mm Hg in the extraction chamber 15.

In the above arrangement, linear first trajectories (e.g. the trajectory 14) exist along which molecules may travel from the entrance orifice 10 through the entrance chamber 3 and the extraction chamber 15 to the evacuation port 4 without deflection. In accordance with the invention, an exit orifice means 11 preferably comprises a hollow conical member 12 mounted in a recess 13 in the adaptor flange 1 as shown in FIG. 1. A PTFE washer 8 is disposed between the body 2 and the hollow conical member 12 in order to electrically insulate it from the body 2. The conical member 12 has a hole in its apex through which ions may pass from the extraction chamber 15 to a mass analyzer (See FIG. 2 and the description below). The length of the conical member 12 is selected so that when in position it is short, typically by about 1 mm, of any of the linear first trajectories 14 along which molecules may pass from the entrance orifice 10 to the evacuation port 4 so that molecules travelling along these trajectories do not enter the exit orifice means. Different conical members having different diameters for the hole in their apex, may be provided. Typically three conical members with holes 0.5, 1.0, and 1.5 mm diameter may be provided to allow optimum performance under different conditions of pressure in the extraction chamber. Generally speaking, cones having the largest diameter holes result in greater sensitivity but the maximum size of hole which can be employed is limited by the need to maintain a sufficiently low pressure in the vacuum system on the exit side of the exit orifice means 11 which typically contains a mass analyzer.

The presence of the linear trajectories (exemplified by 14) between the entrance orifice 10 and the evacuation port 4, and the fact that there is no similar linear trajectory from the entrance orifice 10 through the exit orifice means 11 provides very efficient removal of neutral solvent molecules from the extraction chamber 15 and also minimizes the number of neutral molecules which pass through the exit orifice means 11. This allows the entrance orifice 10 to be made considerably larger than the entrance orifice of prior electrospray ionization sources and greatly reduces the tendency for the orifice to become blocked. Ionization sources according to the invention therefore typically require less maintenance than prior sources.

In order to deflect at least some ions travelling along one or more of the linear trajectories through the hole in the hollow conical member 12, a potential gradient is generated in the extraction chamber 15 by means of the power supply 16 which maintains a potential difference of approximately 45 volts between the body 2 and the hollow conical member 12. The potential on the hollow conical member 12 is arranged to be negative with respect to the body 2 when positive ions are to be analyzed, and positive when negative ions are to be analyzed.

In an alternative embodiment (FIG. 5) the hollow conical member 12 is electrically connected to the body 2 and the potential gradient is generated by means of an electrode 17 to which the power supply 16 is connected. The electrode 17 is disposed downstream of the hollow conical member 12, typically by about 5 mm, and is fitted in an electrode insulator 18 which is sealed into the body 2 by means of an 'O' ring 38. In this embodiment the power supply 16 is arranged to apply a positive potential up to about 500 volts to the electrode 17 for positive ion analysis, and a similar negative potential in the case of negative ion analysis. In both the FIG. 4 and FIG. 5 embodiments, the potential generated by the power supply 16 may be adjusted to maximise the transmission of ions into the mass analyzer.

Irrespective of the method by which it is established, the potential gradient in the extraction chamber 15 deflects through the exit orifice means 11 at least some of the ions which enter it along one or more of the linear trajectories 14.

Figure 2:
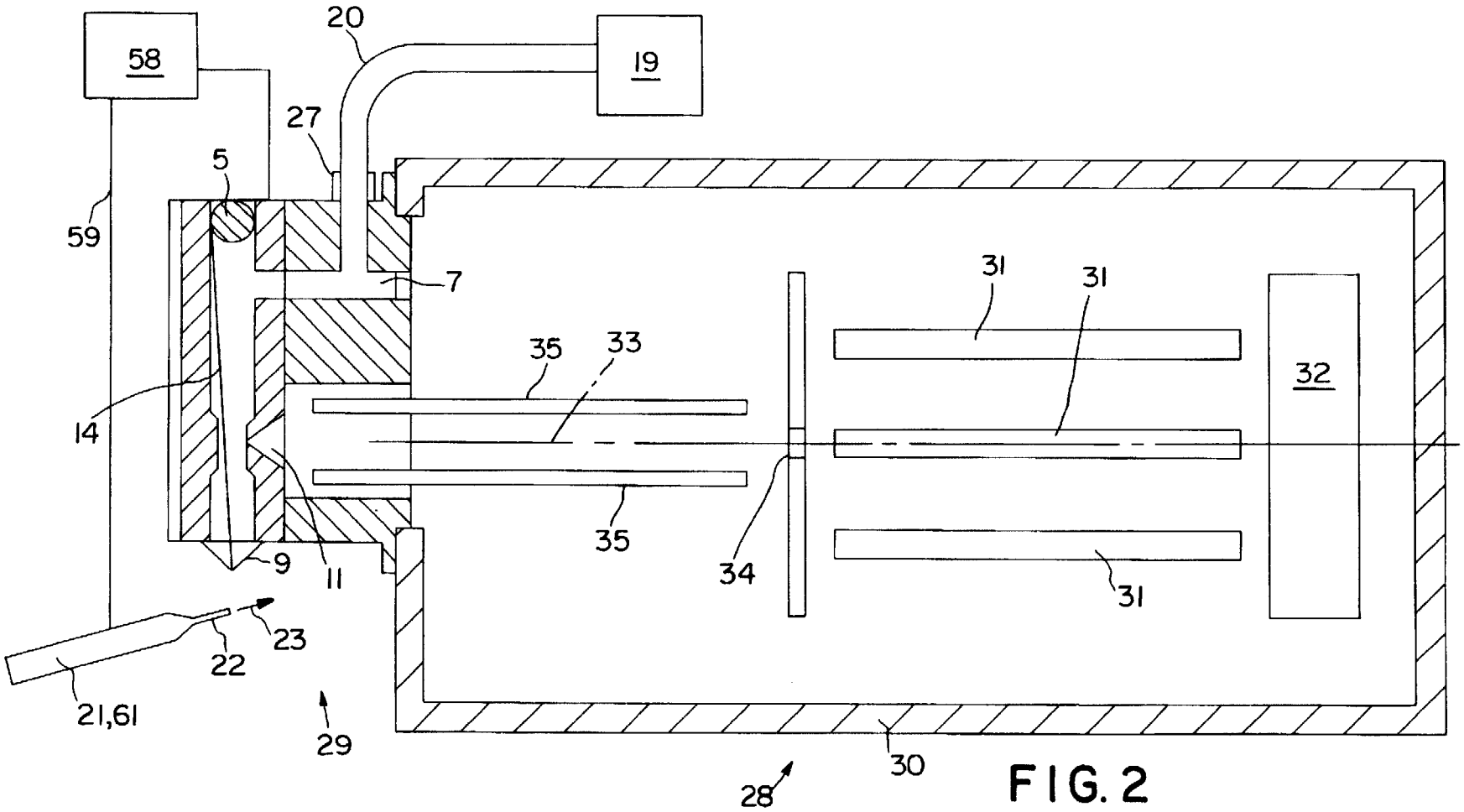
FIG. 2 is a schematic drawing of a mass spectrometer according to the invention.

Aerosol generating means comprise an electrospray probe assembly 21 which contains an electrically conductive capillary tube 22 and is disposed outside the body 2. The capillary tube 22 is maintained at a potential of about 3.5 kV relative to the body 2 by an electrospray power supply 58 (FIG. 2). A solution containing a sample to be ionized is pumped through the capillary tube 22 so that an aerosol is generated adjacent to the entrance orifice 10. The velocity of individual particles comprised in the aerosol immediately on leaving the capillary tube 22 may be represented by the vector 23 (FIG. 1) which is the resultant of two mutually perpendicular components 25, 26 with the component 26 being parallel to a notional backwards projection 24 of one of the linear first trajectories 14. In accordance with the invention the probe assembly 21 is directed in such a way that for at least a majority of particles the velocity component 26 is smaller than the component 25 in the perpendicular direction, regarding a negative value for the component 26 (i.e., a direction away from the entrance orifice 10) as being smaller than a zero value for the component. Generally speaking this means that at least the majority of the particles leave the end of the capillary tube 22 in a direction which makes an angle of at least 45° to the first linear trajectories 14. Despite this, however, it has been found that at least some particles electrosprayed from the capillary tube 22 do enter the orifice 10 because the flow of gas from the surrounding atmosphere into the orifice 10 due to the evacuation of the entrance chamber 3 causes at least some of them to be deflected away from the direction of vector 23 after they have left the end of the capillary tube 22 and so pass through the orifice 10.

Figure 3:
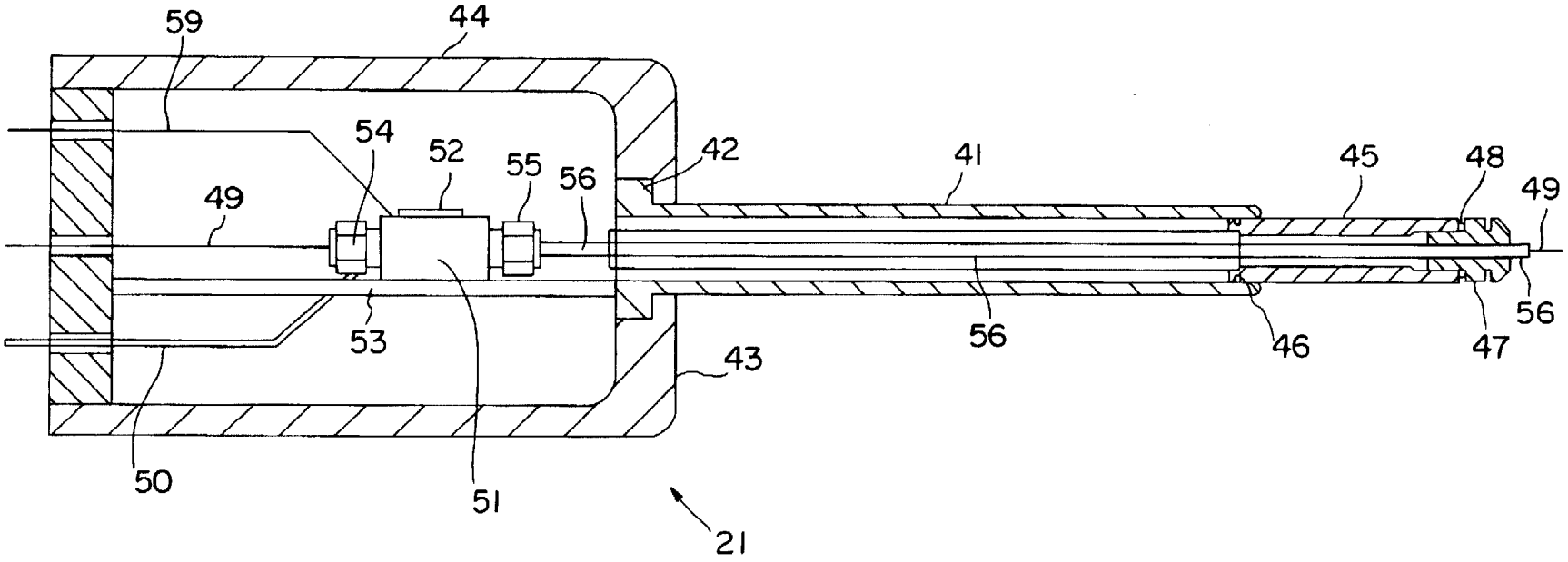
FIG. 3 is a sectional view of an electrospray ionization probe suitable for use with the invention.
Figure 4:
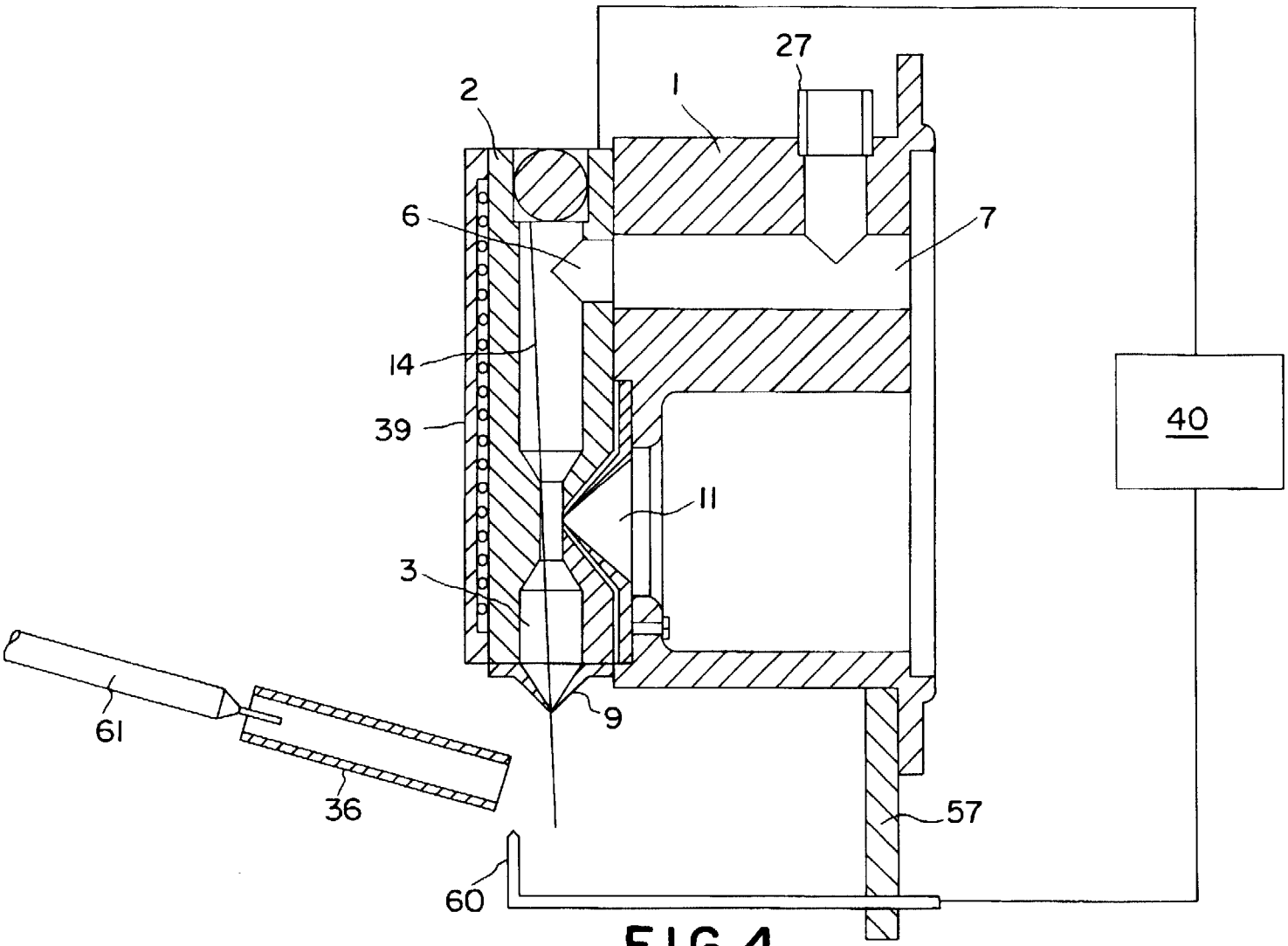
FIG. 4 is a schematic diagram of an APCI source according to the invention.
Figure 5:
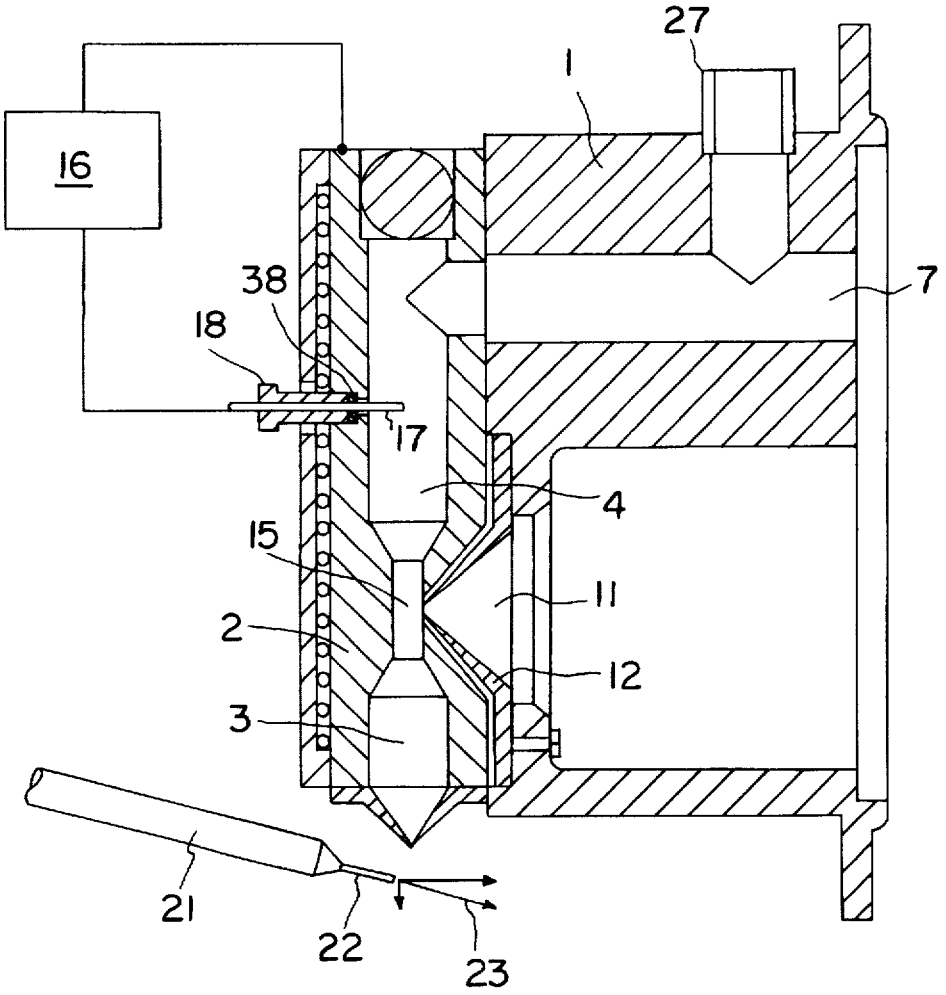
FIG. 5 is a sectional view of an alternative type of ionization source according to the invention.

An embodiment of an APCI source according to the invention is shown in FIG. 4. It is identical to the electrospray embodiment shown in FIG. 1 save for the replacement of the electrospray probe 21 (FIG. 1) with an aerosol generating means 61 (which comprises a coaxial flow nebulizer similar to that shown in FIG. 3) and aerosol heating means 36 which comprises a strongly heated tube. Droplets comprised in the aerosol produced by the generating means 61 pass through the heating means 36 and are desolvated so that only gaseous phase molecules emerge from the end of the heating means. Also provided is a sharply pointed discharge electrode 60, mounted from an insulator 57 as shown in FIG. 4. The discharge electrode 60 is connected to a +3.0 kV corona discharge power supply 40 so that a corona discharge is established between the electrode 60 and the body 2 through which passes the stream of particles generated by the generating means 61. In this way, positive ions which subsequently pass through the entrance orifice 10 are generated. (Negative ions may be generated by connecting the electrode 60 to a negative supply). The aerosol generating means 61 is oriented with respect to the body 2 and the entrance orifice 10 exactly as the electrospray probe 21 is oriented in the case of the electrospray embodiment of the invention. An APCI mass spectrometer may therefore be constructed according to FIG. 2 by replacement of the electrospray probe 21 and power supply 58 by the arrangement of the aerosol generating means 61, aerosol heating means 36, electrode 60 and power supply 40 shown in FIG. 4. The electrode 60 may be left in place (connected to the body 2) even if the ionization source is used in the electrospray mode. In this way a combined APCI/electrospray mass spectrometer may be provided, requiring merely the replacement of the aerosol generating means 61 by the probe 21 (or v.v.) and the switching of the power supplies 58 and 40 to change from one mode to the other.

Heating means comprising a coiled heating element 37 disposed in good thermal contact with the body 2 and covered by a cover plate 39 (FIG. 1) are provided to maintain the temperature of the body 2 at any desired value, typically about 70° C. for thermally labile samples such as proteins or about 150° C. for other samples.

Referring next to FIG. 2, a mass spectrometer generally indicated by 28 comprises an ionization source 29 as shown in FIG. 1 fitted to a vacuum enclosure 30 which encloses a quadrupole mass filter 31 and an ion detector 32. These components are conventional and are shown only schematically in FIG. 2. Other conventional components necessary for the proper operation of the mass filter and detector have been omitted from the figures for the sake of clarity. As shown in FIG. 2, a second trajectory 33 through the exit orifice means 11 of the ionization source and the entrance aperture 34 of the mass analyzer is coincident with the ion-optical axis of the quadrupole mass filter 31. The angle defined by the intersection of any of the linear trajectories 14 and the second trajectory 33 which passes through the exit orifice means 11 and the mass filter entrance aperture 34 is approximately 90°.

The efficiency of transmission of ions between the ionization source 29 and the entrance aperture 34 is increased by provision of an electrostatic hexapole lens, two poles of which are shown at 35 in FIG. 2.

An electrospray probe suitable for use with the invention is shown in FIG. 3. It comprises a hollow probe shaft 41 made of a rigid insulating material comprising a flange 42 which is located in a recess in the end wall 43 of a cylindrical housing 44. A stainless steel shaft extension 45 is sealed into the end of the shaft 41 by means of an 'O' ring 46, and a hollow stainless steel tip 47 is sealed into the end of the extension 45 by means of a second 'O' ring 48. A narrow bore small diameter capillary tube 49, also of stainless steel, runs the entire length of the probe assembly 21 and is connected at the end remote from the tip 47 to a source of the solution to be analyzed, for example a liquid chromatographic column.

A supply of nebulizing gas (e.g., nitrogen) is fed via the pipe 50 to a 'T' connector 51 which is attached by a clamp 52 to a support plate 53 fixed in the housing 44. The capillary tube 49 passes straight through the remaining two unions on the 'T' connector 51 and is sealed in the union 54. A length of larger bore tube 56 through which the capillary tube 49 passes without a break, is sealed in the union 55 on the 'T' connector 51 and extends through the hollow interiors of the probe shaft 41, the shaft extension 45, and the probe tip 47. The capillary tube 49 protrudes about 0.5 mm from the end of the tube 56 so that the nebulizing gas emerges from the tube 56 and assists the electrostatic nebulization of the solution emerging from capillary tube 49.

In order to cause the electrospray ionization, the electrospray power supply 58 (FIG. 2) is connected to a lead 59 which is connected to the 'T' connector 51 so that the connector and the tubes 56 and 49 are maintained at the electrospray potential.

In use, the probe assembly 21 is merely clamped in the previously described orientation with the end of the capillary tube adjacent to the entrance orifice 10, as shown in FIGS. 1 and 2.

It should be apparent that various modifications may be made o the described embodiments without departing from the spirit and scope of the attached claims.

What is claimed is:

1. An ion source for generating ions for analysis, comprising an extraction chamber formed in a body, said extraction chamber being in communication with an evacuation port, evacuation means connected to said evacuation port for maintaining the pressure in said extraction chamber less than 100 mm Hg, an entrance orifice leading into said extraction chamber and disposed opposite to said evacuation port so that at least some molecules entering said extraction chamber through said entrance orifice may pass through said extraction chamber on linear first trajectories and enter said evacuation port, exit orifice means leading through said body from said extraction chamber, means for generating a potential gradient in said extraction chamber for deflecting said ions for analysis through said exit orifice on second trajectories which are inclined at between 30° and 150° to said linear first trajectories, particle generating means for receiving a solution in which a sample may be dissolved and generating therefrom a stream of particles which intersects outside said body a notional backwards projection of at least one of said linear first trajectories through said entrance orifice, and means for electrically charging at least some of the particles comprised in said stream before they reach said notional backwards projection, said particle generating means being disposed with respect to said entrance orifice so that immediately on leaving said particle generating means at least the majority of particles comprised in said stream have a velocity whose resolved component towards said entrance orifice in a direction parallel to any one of said linear first trajectories is smaller than the resolved component in a perpendicular direction.

2. An ion source as claimed in claim 1 wherein an entrance chamber is additionally provided between said entrance orifice and said extraction chamber, and wherein both said entrance chamber and said evacuation port are of greater diameter than said extraction chamber.

3. An ion source as claimed in claim 1 which is an electrospray ion source and wherein said particle generating means comprises aerosol generating means and said means for electrically charging said particles comprises means for maintaining said aerosol generating means at a high potential relative to said body.

4. An ion source as claimed in claim 1 which is an atmospheric pressure ionization source and wherein said particle generating means comprises aerosol generating means for generating droplets from a solution, and aerosol heating means are provided for generating molecules in the gaseous phase from said droplets by evaporating solvent therefrom.

5. An ion source as claimed in claim 4 wherein said means for electrically charging said particles comprise discharge electrode means disposed adjacent to said stream and maintained at a potential which results in the formation of a corona discharge between said discharge electrode and said body.

6. An ion source as claimed in claim 1 wherein means are provided for heating said body.

7. An ion source as claimed in claim 1 wherein said exit orifice means comprises a hollow conical member comprising a hole in its apex, a portion of which member may extend into said extraction chamber.

8. An ion source as claimed in claim 1 wherein said particle generating means is oriented so that said stream of particles intersects a notional projection of any of said linear trajectories backwards through said entrance orifice at an angle of about 90°.

9. A mass spectrometer comprising an ion source as claimed in claim 1 and further comprising a mass analyzer disposed to receive ions passing through said exit orifice means.

10. A mass spectrometer as claimed in claim 9 further comprising an analyzer entrance aperture disposed so that those of said second trajectories which make an angle of approximately 90° to one of said linear first trajectories pass through it.

11. A method of ionization comprising generating a stream of particles from a solution in which a sample to be ionized may be dissolved, electrically charging at least some of the particles in said stream, receiving at least some of the particles so charged through an entrance orifice into an extraction chamber formed within a body along linear first trajectories which pass from said entrance orifice through said extraction chamber into an evacuation port, evacuating said chamber through said evacuation port to maintain the pressure in said extraction chamber less than 100 mm Hg, generating in said chamber a potential gradient to deflect at least ions travelling along at least some of said linear first trajectories along second trajectories through an exit orifice means, said second trajectories being inclined at between 30° and 150° to said linear first trajectories, said stream of particles being oriented with respect to said body and said entrance orifice so that immediately on their formation at least the majority of particles comprised in said stream of particles have a velocity whose resolved component towards said entrance orifice in a direction parallel to any of said linear first trajectories is smaller than the resolved component in a perpendicular direction.

12. A method as claimed in claim 11 wherein said solution is electrosprayed from an aerosol generator or capillary tube maintained at a high potential relative to said body to produce a stream of electrically charged particles, at least some of which enter said entrance orifice.

13. A method as claimed in claim 11 wherein said stream of particles is produced by an aerosol generator, at least some of which particles may subsequently acquire electrical charge by passing through a discharge established between a discharge electrode and said body.

14. A method as claimed in claim 13 wherein a solution is passed into said aerosol generator to generate an aerosol comprising droplets of said solution, and solvent is subsequently evaporated from said droplets by passing them through aerosol heating means before they are electrically charged.

15. A method of mass spectrometrically analyzing a solution in which a sample may be dissolved comprising a method as claimed in claim 11 and the additional step of mass analyzing ions which pass through said exit orifice means along said second trajectories.

* * * * *